US005237986A

United States Patent [19]

Seppala et al.

[11] Patent Number: 5,237,986

[45] Date of Patent: Aug. 24, 1993

[54] RESPIRATOR HARNESS ASSEMBLY

[75] Inventors: Harold J. Seppala, St. Paul, Minn.; Alex A. Wawiluk, Overijse, Belgium

[73] Assignee: Minnesota Mining and Manufacturing Company, St. Paul, Minn.

[21] Appl. No.: 699,690

[22] Filed: May 14, 1991

Related U.S. Application Data

[63] Continuation of Ser. No. 565,702, Aug. 13, 1990, abandoned, which is a continuation of Ser. No. 260,137, Oct. 20, 1988, abandoned, which is a continuation of Ser. No. 119,903, Nov. 20, 1987, abandoned, which is a continuation of Ser. No. 945,560, Dec. 23, 1986, abandoned, which is a continuation of Ser. No. 744,576, Jun. 14, 1985, abandoned, which is a continuation-in-part of Ser. No. 650,168, Sep. 13, 1984, abandoned.

[51] Int. Cl.[5] ..... A62B 17/04; A62B 18/02; A62B 18/08

[52] U.S. Cl. ..... 128/201.23; 128/201.25; 128/205.25; 128/206.13; 128/206.19; 128/206.21; 128/207.11

[58] Field of Search ..... 128/201.23-201.26, 128/201.28, 205.25, 205.29, 206.12-207.13, DIG. 18, DIG. 26, 132 R, 139; D2/239; 2/DIG. 7; 24/3 R, 3 B, 3 L, 68 R, 442, 366, 115 R, 115 K, 205 R, DIG. 1

[56] References Cited

U.S. PATENT DOCUMENTS

| | | | |
|---|---|---|---|
| 2,008,677 | 7/1935 | Booharin | 128/146 |
| 2,056,692 | 10/1936 | Roche | 128/146 |
| 2,149,067 | 2/1939 | Otero | 128/139 |
| 2,176,709 | 10/1939 | Dym | 128/207.11 |
| 2,281,744 | 5/1942 | Brunner | 128/146 |
| 2,505,173 | 4/1950 | Conley | 128/206.17 |
| 2,762,368 | 9/1956 | Bloomfield | 128/206.28 |
| 2,843,121 | 7/1958 | Hudson | 128/146 |
| 3,013,556 | 12/1961 | Galleher | 128/146 |
| 3,033,200 | 5/1962 | Stanley | 128/207.11 |
| 3,082,767 | 3/1963 | Matheson | 128/146 |
| 3,299,889 | 1/1967 | Stanley | 128/207.11 |
| 4,002,167 | 1/1977 | Rambosek | 128/205 |
| 4,074,397 | 1/1977 | Rosin | 24/73 |
| 4,077,068 | 3/1978 | Anderson | 2/428 |
| 4,112,521 | 9/1978 | Uke | 24/442 |
| 4,520,509 | 6/1985 | Ward | 2/206 |
| 4,573,464 | 3/1986 | Yo | 128/206.12 |
| 4,848,334 | 7/1989 | Bellm | 128/207.11 |

FOREIGN PATENT DOCUMENTS

| | | | |
|---|---|---|---|
| 2059782 | 4/1981 | United Kingdom | 128/207.11 |
| 2092009 | 8/1982 | United Kingdom | 128/206.21 |

*Primary Examiner*—David Isabella
*Assistant Examiner*—K. Reichle
*Attorney, Agent, or Firm*—Gary L. Griswold; Walter N. Kirn; David W. Anderson

[57] ABSTRACT

A harness assembly for disposable respirators and more particularly to a respirator harness assembly having an open light-weight elastic loop with a single point connector which enables the respirator to be easily and quickly applied, and provides for temporary "storage" of the respirator during periods of non-use is disclosed.

4 Claims, 4 Drawing Sheets

RESPIRATOR HARNESS ASSEMBLY

This application is a continuation of application Ser. No. 565,702 filed Aug. 13, 1990, and now abandoned which was a continuation of application Ser. No. 260,137 filed Oct. 20, 1988, and now abandoned, which was a continuation of application Ser. No. 119,903 filed Nov. 10, 1987, and now abandoned, which was a continuation of application Ser. No. 945,560, filed Dec. 23, 1986, and now abandoned, which was a continuation of application Ser. No. 744,576, filed Jun. 14, 1985, and now abandoned, which was a continuation-in-part of application Ser. No. 650,168, filed Sep. 13, 1984, and now abandoned.

BACKGROUND OF THE INVENTION

The present invention relates to a harness assembly for disposable respirators and more particularly to a respirator harness assembly having an open light-weight elastic loop with a single point connector means which enables the respirator to be easily and quickly applied, and provides for temporary off the face "storage" of the respirator during periods of non-use. The harness assembly is essentially self-adjusting to provide adequate tension and an even distribution of pressure over the entire area of the respirator in contact with the face during use.

Harness assemblies for replacable cartridge or replaceable filter respirators approved by the National Institute of Occupational Safety and Health (NIOSH) and the Mine Safety and Health Administration (MSHA) under Subpart K of Part II, 30 Code of Federal Regulations, Federal Register, Vol. 37, No. 59, Mar. 25, 1972, must be designed and constructed to hold the components of the respirator in position against the wearer's body and must be adjustable and replaceable. These respirator harness assemblies have tended to be rather heavy and cumbersome devices consisting of a plurality of heavy duty elastic or rubber straps, buckles, slides and fastening devices. A number of such harness assemblies have been provided with snap-on fasteners consisting of a D-ring and a flat folded clip or similar device for connecting the two ends of the headband together.

Disposable respirators approved by NIOSH and MSHA, and designed for respiratory protection in hazardous particulate atmospheres, such as dust/mist and dust/mist/fume respirators, have traditionally been required to have a harness consisting of a pair of elastic straps secured at spaced points on opposite side edges of the respirator, the so-called four point support requirement. The respirator is secured in place by passing the straps over the user's head and then arranging the straps so that one strap is below the ears and the other strap is above the ears. The elastic straps may then be adjusted to obtain a fit against the user's face by evenly distributing pressure over the entire area of the respirator in contact with the face. Although disposable respirators provided with harnesses of the type described above generally performed satisfactorily in use, a persistent problem has been that many workers consistently do not use their respirators in the workplace. Inquiry as to the reasons for such non-use has revealed that a primary reason was the inconvenience and aggravation experienced in passing the straps over the user's head each time the respirator was applied or removed—this was especially pronounced when the user was encumbered with auxilliary safety or similar equipment such as hard hats, welder's helmets, goggles, spectacles, miner's lamps, hats or caps, hairnets and hearing protection. Additionally, many workers such as coal miners and welders have numerous occasions when they are not exposed to a hazardous atmosphere and a respirator is not required. During such periods of non-use, these workers would prefer to remove their respirators. However, since they are encumbered with auxilliary safety equipment, removal of their respirators is, at best, an inconvenient and aggravating process. Consequently, many such workers choose not to use a respirator at all.

Obviously, no respiratory protection is afforded a worker by even the best and most efficient respirator if the worker does not use it. It is to the elimination of the above noted reasons for not using a respirator that the present invention is directed.

SUMMARY OF THE INVENTION

The present invention relates to a respirator harness assembly for disposable respirators having an open light-weight elastic loop with a single point connector means which enables the respirator to be easily and quickly applied by a worker—even by a worker wearing heavy workgloves, and also provides temporary off the face storage of the respirator during periods of non-use. The harness assembly is essentially self-adjusting to provide adequate tension and an even distribution of pressure over the entire area of the respirator in contact with the face, said harness assembly comprising elastic loop supports along each side edge of the respirator, and an open light-weight elastic loop with a single point connector means, extending between said loop supports. The two free ends of the open elastic loop are each provided with a coacting connector element which interconnect to close the elastic loop. The harness assembly permits the respirator to be applied by simply grasping the connector element on each of the free ends of the elastic loop and passing the loop ends around the back of the user's head and interconnecting the connector elements. The thus closed elastic loop thereby provides the functional equivalent of a pair of elastic straps which have been considered to be necessary to gain approval by NIOSH and MSHA. The elastic nature of the loop and the ability of the loop to slide freely through the support means provide the self-adjusting feature to the harness and thus provide adequate tension and an even distribution of pressure about the periphery of the respirator. Removal of the respirator is accomplished by reversing the above procedure.

DETAILED DESCRIPTION OF THE INVENTION

Referring now more particularly to the drawings, respirator 10, as shown, is representative of disposable dust/mist and dust/mist/fume respirators comprised of a light, porous, fibrous fabric having a rounded cupped shape. It is large enough to fit over the nose, mouth and chin in a non-constricting spaced-away manner, and can be conformed to make a snug marginal fit such that breathing causes substantially all of the air to pass in and out through the porous fabric structure. If desired, a thin pliable metal strip 11 may be provided at the upper central peripheral edge of the respirator to aid in conforming the respirator over the nose of the wearer.

Figure 1:
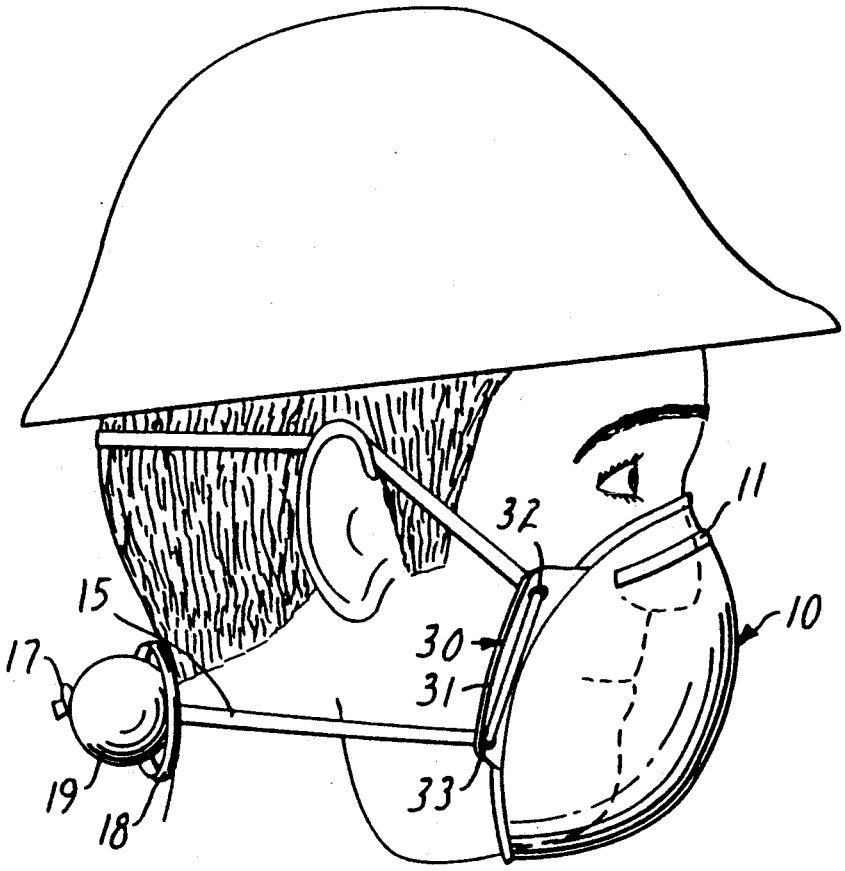
FIG. 1 is a side view showing a cupped shape respirator as worn by a user with the respirator held in place by the respirator harness assembly of the present invention.
Figure 2:
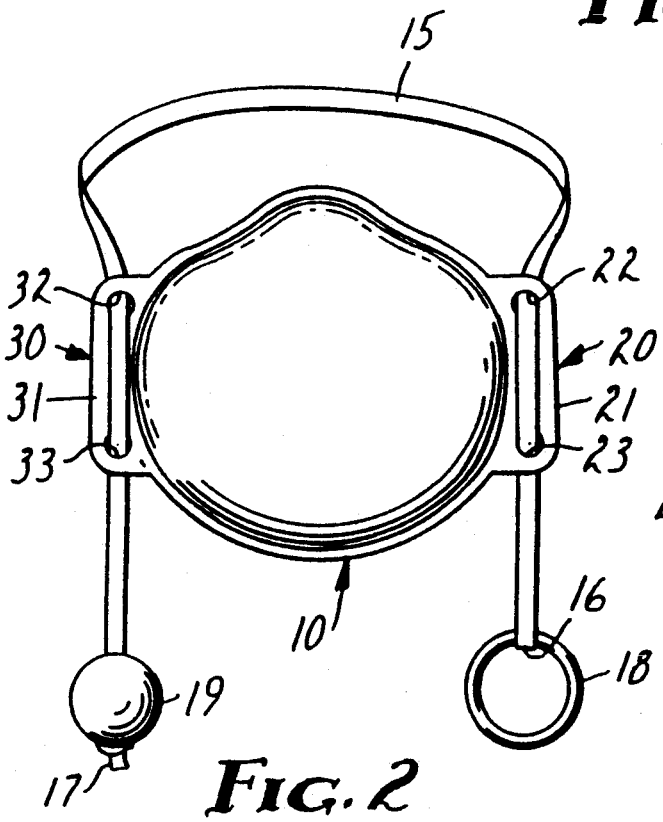
FIG. 2 is a front view of the respirator of FIG. 1 with the respirator harness assembly of the present invention.
Figure 3:
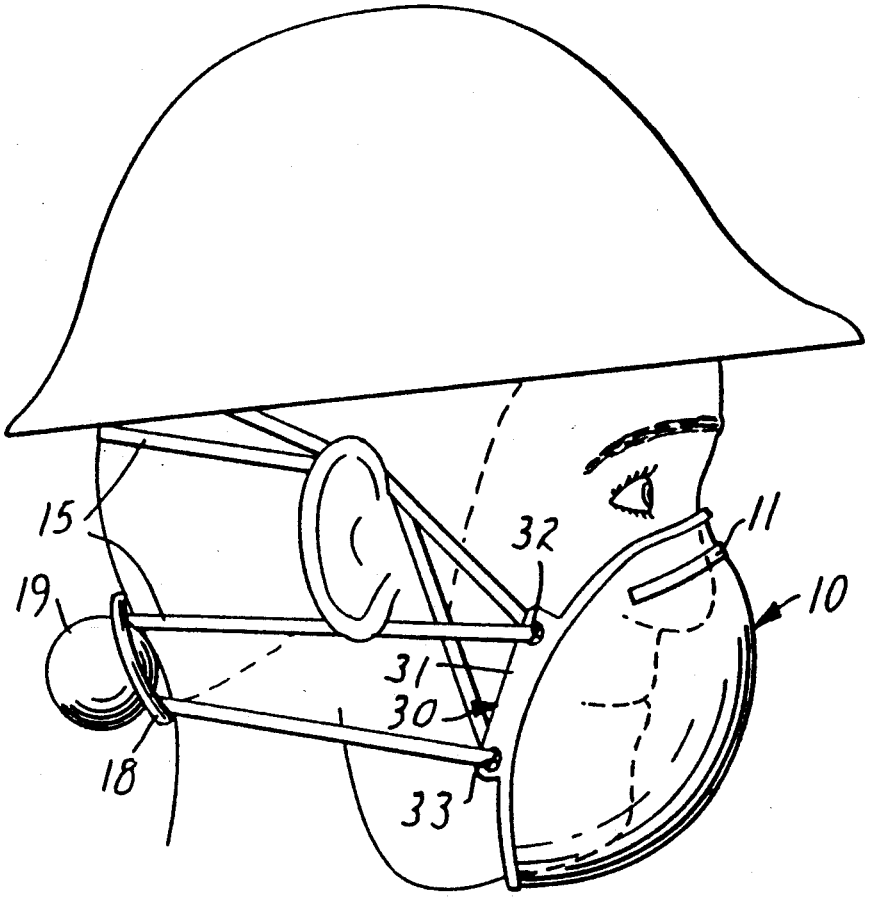
FIGS. 3 and 4 are views corresponding to FIGS. 1 and 2, respectively, showing another embodiment of the invention.
Figure 4:
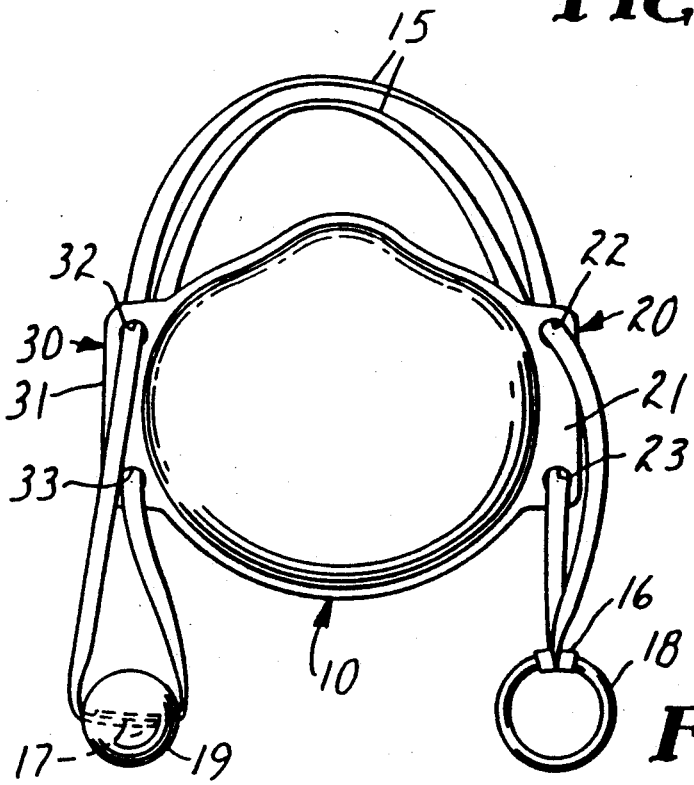

As most clearly seen in FIGS. 2 and 4, light-weight elastic loop 15 is an open elastic loop which is threaded through apertures 22 and 23, spaced about 1.75 inches (4.5 cm) apart, provided in tab 21 of elastic loop support means 20 and through apertures 32 and 33 provided in tab 31 of elastic loop support means 30. Elastic loop 15 is preferably a light-weight braided elasticized fabric about 0.25 inch (0.63 cm) wide but can be formed of a rubber or elastic polymeric material, as is well known in the art. The degree of elasticity of elastic loop 15 dictates the actual length thereof. It has been found that for the braided elasticized fabric described above and illustrated in FIGS. 1 and 2, a length of about 26 inches (66 cm) provides a snug fit of the respirator to the user's face. In the embodiment illustrated in FIGS. 3 and 4, the braided elasticized fabric had a length of 48 inches (122 cm).

Figure 5:
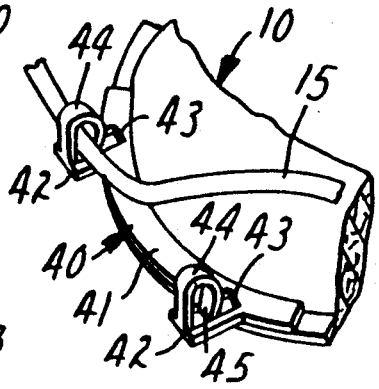
FIG. 5 is a fragmentary perspective view of a portion of another embodiment of the respirator harness assembly of the present invention.

As illustrated in FIGS. 2 and 4, elastic loop support means 20 and 30 comprise rectangular tabs 21 and 31, measuring about 0.5 inch×2.5 inches (1.3 cm×6.4 cm), conveniently formed as extensions of the respirator during the respirator molding procedure. The elastic loop support means 40, illustrated in FIG. 5, comprises a base 41 shaped to conform to the curvature of the body of respirator 10. Outwardly extending rectangular flanges 42, spaced about 1.75 inches (4.5 cm) apart, are provided on the outer convex edge adjacent each end of base 41. A central rectangular recess 43 is provided in each flange 42 for a purpose to be described. At the outer end of recess 43 and extending upwardly from the terminus of each flange 42 is a U-shaped member 44. The free end 45 of U-shaped member 44 is slightly tapered and extends into recess 43 adjacent its inner end. Elastic loop support means 40 is formed of polypropylene by injection molding. As shown in FIG. 5, elastic loop support means 40 is adhesively or otherwise bonded along each side edge of respirator 10. If desired, the bottom surface of base 41 may be provided with a series of short pin-like projections or may be otherwise textured to provide a more secure adhesive bond. An elastic loop 15, separately fabricated with a coacting connector member 18 and 19 on each end thereof, can then be threaded into elastic loop support means 40 by simply pressing a portion of elastic loop 15 against the free end 45 of U-shaped member 44. The rectangular recess 43 permits free end 45 of U-shaped member 44 to slide in said recess and the elastic nature of U-shaped member 44 permits the free end 45 to be slightly upwardly distorted so that elastic loop 15 can be received within the legs of the U.

Figure 7:
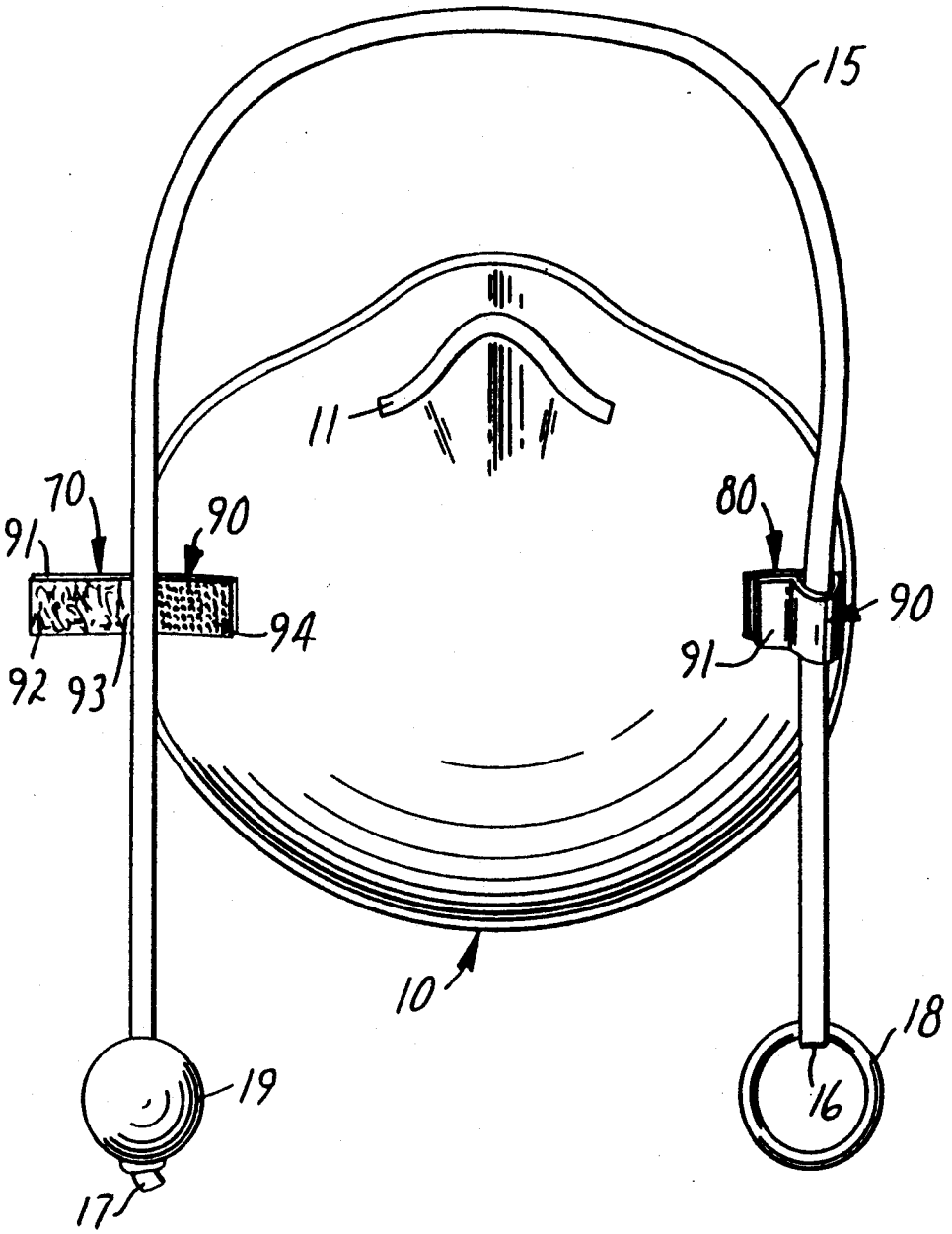
FIG. 7 is a front view of a respirator showing another embodiment of the respirator harness assembly of the present invention.
Figure 8:
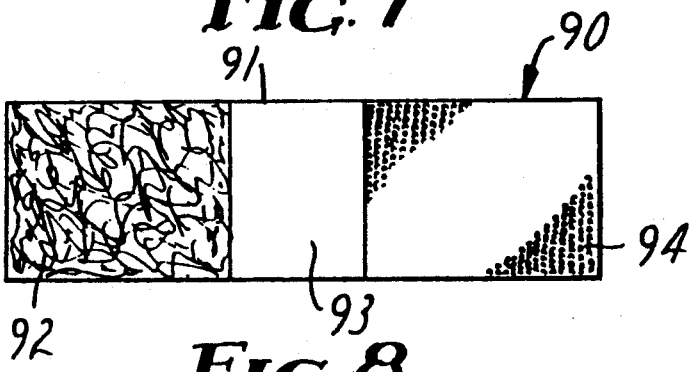
FIG. 8 is a plan view of the flexible fabric fastener tab forming the elastic loop support means of the respirator harness assembly of FIG. 7.

In a further embodiment of the invention illustrated in FIGS. 7 and 8, elastic loop support means 70 and 80 are identically formed and comprise a rectangular tab 90 about 1 inch×1.75 inches of a flexible fabric fastener of the hook and loop type described in U.S. Pat. No. 3,009,235. The dimensions of tab 90 may be varied as desired. As used herein, the term hook and loop type fastener includes those fasteners wherein the hook structures or the loop structures have been modified to form the so-called hook and pile fastener and the mushroom and pile fastener. Typically, tab 90 comprises a flexible fabric backing 91 with a loop portion 92 along one end thereof, a clear central portion 93 adjoining the loop portion and a hook portion 94 along the other end thereof, each portion comprising approximately one-third of the tab. Tabs 90 may be attached to the respirator in the positions shown in FIG. 7 by sewing, sonic welding or with an adhesive. The width of the tab 90 serves to separate the elastic loop 15 to effectively provide two elastic straps secured at spaced points on the opposite side edges of the respirator. In use, elastic loop 15 is placed onto the clear central portion 93 of tab 90 and the free end of tab 90 is brought into juxtaposition with the other (attached) end of the tab. The hooks will then engage the loops and slidingly hold elastic loop 15 in the clear central portion 93. Tabs 90 will then operate as the elastic loop support means 70 and 80. Tabs 90 can be similarly used in place of elastic loop support means 40.

The free ends 16, 17 of elastic loop 15 are each provided with a coacting connector element 18, 19. In the illustrated embodiments of FIGS. 1 through 4, one connector element 18 is a ring having an inner diameter about 1⅜ inches (3.5 cm) and the other connector element 19 is a ball having a diameter fractionally less than the inner diameter of the ring such that it will pass through the ring.

Figure 6:
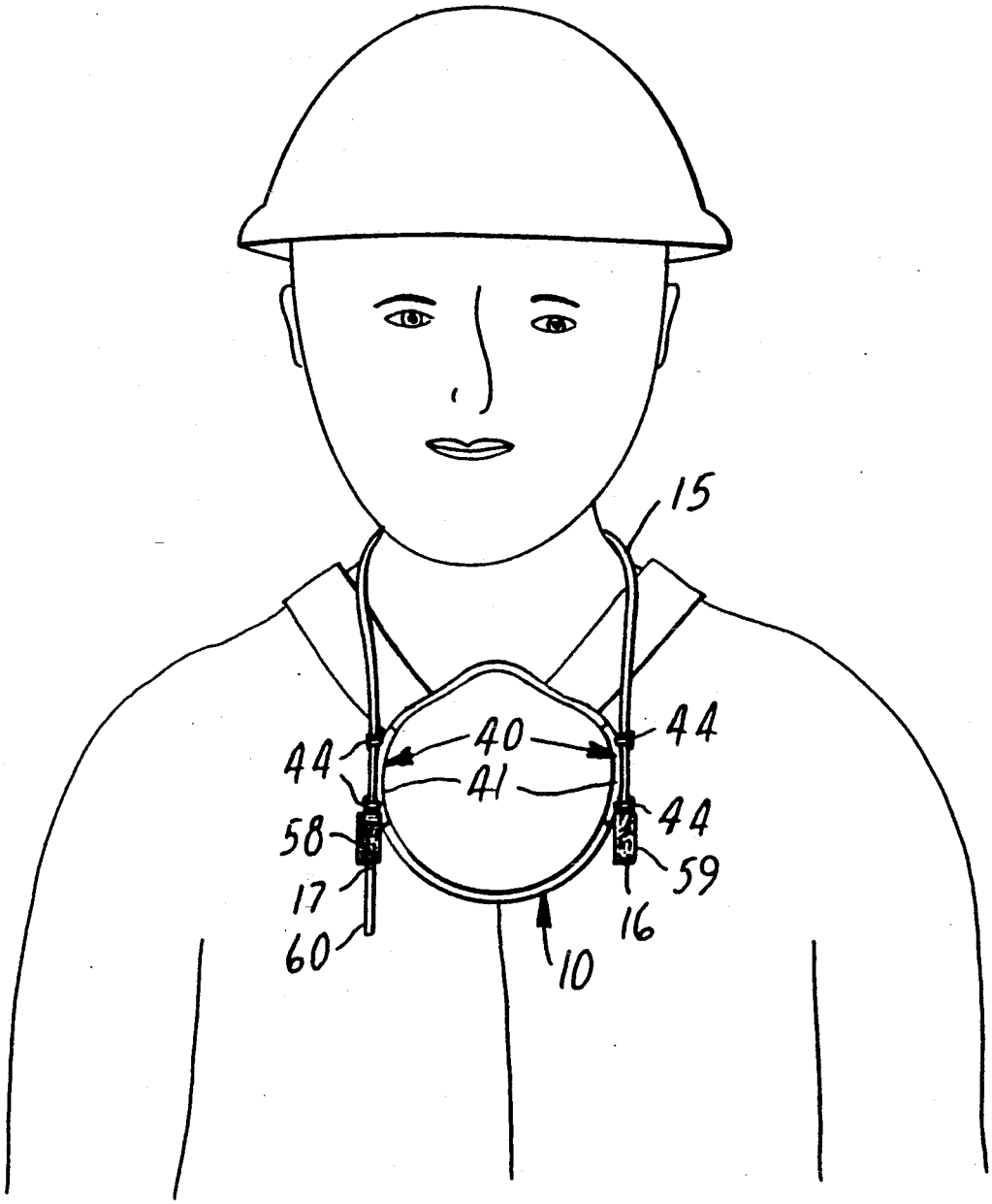
FIG. 6 is a front view of another embodiment of the respirator harness assembly of the present invention and showing the respirator in its temporary off the face storage position.

In the embodiment shown in FIG. 6, the free ends 16, 17 of elastic loop 15 are each provided with a coacting hook and loop fastener connector element 58, 59 (see U.S. Pat. No. 3,009,235). Connector element 58 comprising a hook fastener measuring about 1.75 inches (4.5 cm)×0.75 inch (1.9 cm) is secured, as by sewing, to elastic loop 15 about 2.5 inches (6.4 cm) from its end thereby forming a tab 60 of elastic material extending beyond connector element 58. Connector element 59 comprising a loop fastener having equivalent dimensions to connector element 58 is similarly secured as by sewing, to the end of elastic loop 15.

As clearly seen in FIGS. 2 and 4, the spacing of apertures 22 and 23 in loop support means 20 and apertures 32 and 33 in loop support means 30 correspond to each other. Reinforcing means (not shown) in various forms may be included in the formation of tabs 21 and 31.

The respirator harness assembly illustrated in FIGS. 3 and 4, wherein elastic loop 15 is a doubled open loop, is particularly suited for heavier respirators. The harness assembly provides four straps which girdle the user's head as shown in FIG. 3, but is otherwise identical in operation and function to the harness assembly shown in FIGS. 1 and 2.

The harness assembly of the present invention makes it extremely simple for a worker to don a respirator even while wearing a hard hat due to the longer "effective length" of elastic loop 15. As can be clearly seen in FIGS. 2 and 4, elastic loop 15 can be pulled upwardly until connector elements 18 and 19 are adjacent apertures 23 and 33, respectively. In this manner, the portion of elastic loop 15 extending outwardly between apertures 22 and 32 is lengthened. Elastic loop 15 can then be easily passed over the worker's head, including the hard hat, and allowed to hang around the worker's neck in the manner of a necklace. At this point, respirator 10 would be lying against the worker's upper chest immediately below the neck in a temporary storage position (see FIG. 6). To wear the respirator, the worker places his left hand over connector element 18 while at the same time grasping the lower portion of tab 21 between the thumb and forefinger. At the same time, connector element 19 and the lower portion of tab 31 is similarly grasped with the right hand. Respirator 10 is then placed over the worker's nose, mouth and chin, tabs 21 and 31 are released and with connector elements 18 and 19 firmly grasped in the left and right hands, respectively, the connector elements and the free ends 16 and 17 of elastic loop 15 are pulled apart and passed around the back of the worker's head and the connector elements 18, 19 are then interconnected. In the embodiments illustrated in FIGS. 1 through 4, interconnection of connector elements 18 and 19 is simply accomplished by passing connector element 19, the ball, through connector element 18, the ring. Removal of respirator 10 is accomplished by simply disconnecting the connector elements 18 and 19 and lightly grasping the respirator at tabs 21 and 31 and bringing the respirator down to a position against the worker's upper chest. The respirator 10 can be "stored" in this off the face position as illustrated in FIG. 6 during periods of non-use when the worker is not exposed to hazardous atmospheres.

In the embodiment illustrated in FIG. 6, respirator 10 is also applied in the aforementioned manner, interconnection of connector elements 58 and 59 being accomplished by merely superimposing connector element 58 and connector element 59 with their "active" surfaces in contact. Removal of respirator 10 can be accomplished with one hand by grasping tab 60 and pulling until connector elements 58 and 59 become disengaged. Respirator 10 can then be placed in the temporary storage position, again with one hand.

It will be immediately apparent that connector elements 18, 19 and 58, 59 may take various other forms such as snaps, magnetic fasteners, friction connectors, etc.

While the respirator harness assembly has been described in relation to a rounded cupped shape single-use respirator, it will be immediately apparent that the harness assembly can be used on other disposable masks and respirators such as flat folded respirators, lightweight dust masks, clean room masks, surgical masks, etc., and such uses are contemplated. It is also understood that other variations and modifications of the illustrative embodiments described herein will become evident to those skilled in the art without departing from the spirit and scope of the invention.

What is claimed is:

1. A respirator and harness assembly comprising:

a respirator adapted to be worn over the mouth and nose of a human wearer;

a harness including:

a single elastic strap having a length sufficient to pass around the head of the wearer to form a first loop and a second loop each extending from said respirator, around the head of the wearer and to said respirator, said strap being broken in one of said first loop or said second loop to form two strap ends;

connector means having two cooperative connector portions attached one to each of said two strap ends for releasably connecting said two straps ends, said connector portions being significantly larger in cross-section than said strap;

two strap attachment means disposed one on each lateral side of said respirator, as said respirator is worn, for slideably receiving said strap and allowing free passage of said strap but not permitting passage of said connector portions regardless of the orientation of said connector portions with respect to said attachment means;

so that, when said respirator is worn on the face of a human wearer and said connector portions are connected, said strap passes from one of said attachment means around the head of the wearer to the other of said attachment means to form said first loop and from said one of said attachment means around the head of the wearer to said other of said attachment means to form said second loop;

so that, when said connector portions are not connected, and one of said first loop or said second loop is broken, the remaining loop may be increased in size by movement of said strap through both of said attachment means until said connector portions contact said attachment means so that said respirator may be separated from the face of the wearer and hung from the neck of the wearer by said remaining loop; and so that, said respirator and harness assembly provides temporary off-the-face storage of said respirator without passing said respirator or said harness over the head of the wearer.

2. A respirator and harness assembly according to claim 1 wherein each of said attachment means comprises at least one hole through each lateral side of said respirator.

3. A harness assembly according to claim 2 wherein each of said attachment means comprises two vertically aligned holes, with reference to said respirator as worn, through each lateral side of said respirator.

4. A respirator and harness assembly comprising:

a respirator adapted to be worn over the mouth and nose of a human wearer;

a harness including:

a single elastic strap having a length sufficient to pass around the head of the wearer to form a first loop and a second loop each extending from said respirator, around the head of the wearer and to said respirator, said strap being broken in one of said first loop or said second loop to form two strap ends;

connector means having two cooperative connector portions attached one to each of said two strap ends for releasably connecting said two strap ends, said connector portions being significantly larger in cross-section than said strap;

at least one hook and loop fastener attached to each lateral side of said respirator, said hook and loop fastener including an elongate flexible backing having one end attached to said respirator, hook structures extending from one side of said backing at one end of said backing, loop structures extending from said one side of said backing at the other end of said backing and a clear portion between said hooks structures and said loop structures free of either said hook structures or said loop structures, wherein said backing is flexed to connect said hook structures and said loop structures to provide an aperture at said clear portion which slideably receives said strap and allows free passage of said strap but does not permit passage of said connector portions regardless of the orientation of said connector portions with respect to said fastener;

so that, when said respirator is worn on the face of a human wearer and said connector portion are connected, said strap passes from one of said fasteners around the head of the wearer to the other of said fasteners to form said first loop and from said one of said fasteners around the head of the wearer to said other of said fasteners to form said second loop;

so that, when said connector portions are not connected, and one of said first loop or said second loop is broken, the remaining loop may be increased in size by movement of said strap through both of said fasteners until said connector portions contact said fasteners so that said respirator may be separated from the face of the wearer and hung from the neck of the wearer by said remaining loop; and so that, said respirator and harness assembly provides temporary off-the-face storage of said respirator without passing said respirator or said harness over the head of the wearer.

* * * * *